United States Patent [19]

Pisani

[11] 4,305,552

[45] Dec. 15, 1981

[54] BEAMER FOR FABRICS OF ANY TYPE

[75] Inventor: Luigi Pisani, Cilavegna, Italy

[73] Assignee: Officina Meccanica Pisani Luigi, Cilavegna, Italy

[21] Appl. No.: 131,207

[22] Filed: Mar. 17, 1980

[30] Foreign Application Priority Data

Mar. 27, 1979 [IT] Italy ..... 21313 A/79

[51] Int. Cl.[3] ..... B65H 17/02

[52] U.S. Cl. ..... 242/67.2

[58] Field of Search ..... 242/67.2, 67.1 R, 65, 242/67.3 R

[56] References Cited

U.S. PATENT DOCUMENTS

| | | | |
|---|---|---|---|
| 510,034 | 12/1893 | Levedahl | 242/67.2 |
| 3,044,726 | 7/1962 | Schellenberg | 242/67.3 R |
| 3,224,698 | 12/1965 | Conti | 242/67.1 R X |
| 3,410,499 | 11/1968 | Schmidt | 242/67.1 R |

*Primary Examiner*—Edward J. McCarthy
*Attorney, Agent, or Firm*—Bucknam and Archer

[57] ABSTRACT

A beaming device for fabrics and in particular for very elastic fabrics is described which comprises a first pair of rollers (3,5) for entraining the fabric from a textile machine, a second pair of rollers consisting of a winding roller 13 around which the said fabric is to be rolled in rolls and driving roller 11. The second pair of rollers turn at a lower speed than the first pair. The winding roller is caused to rotate by the driving roller 11 which in turn is rotated by the entraining roller 3 of the first pair of rollers by means of a transmission comprising a speed controller. The driving roller 11 is arranged between the said first pair of rollers and the beaming roller 23. The fabric to be wound loses any deformation caused by the first pair of rollers when it goes through the part 2' between the two pairs of rollers.

9 Claims, 2 Drawing Figures

BEAMER FOR FABRICS OF ANY TYPE

This invention relates to a beamer for fabrics of any kind, in particular to elastic fabrics. Beamers for fabrics in general are already known to the art and serve for forming rolls to be used on other machines for further working processes.

These rolls can be tentered in overlapping layers from a lap machine or unwound and rewound on overhauling machines, or else they can be measured on an overhauling machine and cut into strips for forming bands and collarets.

The known beamers being characterized by winding the fabric in very tight rolls and considering that when rolling up knitted fabrics, the latter are subjected to strong stretching effects causing the deformation of the original dimensions, it is obvious that, for forming subsequently lapped packs or mattresses, the knitted fabric must be left to rest for a certain time for allowing it to return to its original size before proceeding with further treatments. In addition, when it is required to use this knitted fabric for making very narrow collarets, the rolls must be made very small (from 10 to 15 cm) for avoiding the possibility of the inner tension of the fabric destroying the stability of the roll as such.

It is the purpose of this invention of rolling up particularly elastic fabrics with zero inner tension.

The technical problem for realizing this purpose is that of providing a beamer allowing to wind up the fabrics of the above-mentioned kind in a manner which is independent of their width by pulling them through the complementary working machine used in that moment with just the right stretch required by the operation in course, that is without producing rolls of deformed fabric.

The solution of this technical problem proposes a beamer for fabrics of any kind, in particular for elastic fabrics, formed in general by a first pair of rollers for entraining the cloth from a complementary machine, and by a beamer for receiving the said fabric as a roll, in which the beamer is made to rotate by a driving roller, which, in turn, is made to rotate by the entraining roller of the said first pair of rollers through a transmission comprising a speed controller.

It is evident that a device structured in this manner has the doubtless advantage of sharply separating the handling of the fabric by the complementary machine from the final handling consisting in winding up the fabric in rolls and that the fabric is thus treated in two different ways.

It is still further evident that in the particular case of knitted fabric collarets cut perpendicular to the warp, that is according to the straight yarn, it is now possible to produce in a single operation very narrow rolls (from 2.5 to 3 cm) of a large diameter (over 30 cm), that is still further to satisfy the clothing industry calling for collarets which are very narrow and elastically relaxed avoiding wrinkles or similar troubles in the finished product, consenting at the same time all the machines making such collarets to run uninterruptedly for a longer period of time than that until now used for the same operation when using known beamers.

These and further advantages will become evident from the following description and the accompanying drawings showing an embodiment of the object of this invention without being limited thereto. In these drawings.

Figure 1:
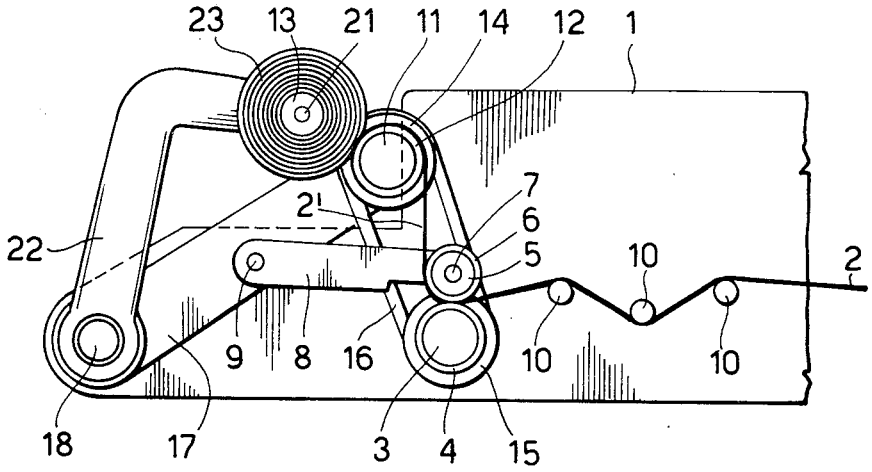
FIG. 1 shows a schematic elevation of the beamer object of this invention.

Referring now to FIG. 1, the beamer object of this invention is shown assembled to the end of a machine for treating sheets of fabric, for example for checking them or for winding them in rolls destined for lap machines, or for cutting them into bands of the desired width.

The fabric 2 is made to advance through this machine by a first pair of rollers collecting it from a reserve, now shown, while subjecting it to a tension which ensures a uniform and regular displacement. The above-mentioned first pair consists of an entraining roller 3 covered with a sheath 4 made of a material having a high coefficient of friction, for example rubber, and of a stretching roller 5, also covered with a sheath 6 of the same material like the other one.

The fabric is made to pass between these two rollers with the stretching roller 5 ensuring to maintain it in contact with the entraining roller 3. For this purpose the stretching roller 5 is idling on a pivot 7 carried by a lever 8 turning around a fixed pivot 9.

In the shown embodiment the beamer is arranged horizontally to the machine so that the stretching roller 5 is pressed by its own weight against the entraining roller, it being evident that, in a vertical arrangement, the stretching roller 5 is to be pressed elastically against the entraining roller using elastic means acting on the lever 8. In front of this first pair of rollers are provided a few stretching bars 10 fixed to the end part 1 and serving for straightening the fabric 2 and eliminating any fold or unevenness in the fabric before reaching the rollers. According to the above the fabric 2 will be stretched and extended with regard to its original state and this dimensional deformation will be the greater, the greater the elasticity of the fabric. It is well known to those experts in this field that this deformation is harmful to further uses because the fabric, when being stretched, is at the same time narrowed assuming an unstable state which, when disappearing, results in modifying the dimensions of the product it is fixed to.

This dimensional deformation is particularly strong in knitted fabrics when cut into very narrow bands. For eliminating this deformation, the proposed beamer is provided with a second pair of rollers which is turning at a slower speed than the first pair. This second pair is provided downstream of the first one and consists of a driving roller 11 covered with a sheath 12 of the same material used for the sheaths 4 and 6, and of a winding up roller 13 without sheath for receiving the roll of fabric 2. The roller 11 is made to rotate by the entraining roller 3 through a transmission comprising a speed controller.

Figure 2:
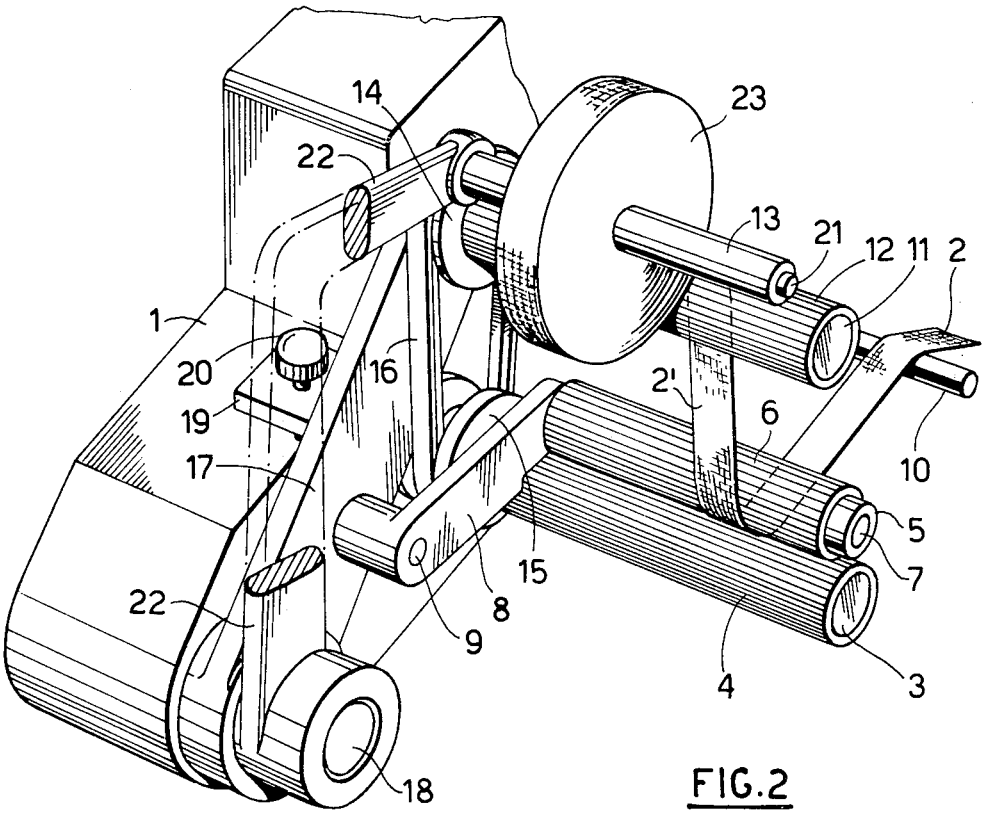
FIG. 2 is an enlarged perspective view of FIG. 1.

Referring now also to FIG. 2 we observe that this transmission consists of a driven pulley 14 integral part of the driving roller 11, by a driving pulley 15 integral part of the entraining roller 3 and by a transmission belt 16 uniting both pulleys.

The speed controller is represented by the same driving pulley 15, of the variable diameter type, with the semidisks axially adjustable, already known to the art. This speed controller allows to rotate the driving roller 11 and the winding roller 13 at a speed inferior to that of the entraining roller 3, so that the fabric 2 completely loses any residual stretching or elongation when passing through the part 2' between the two pairs of rollers.

To maintain the transmission belt at the right tension, the driving roller 11 and the driven pulley 14 are fixed as idlers on a supporting lever 17 centered on a pivot 18 part of the end structure 1 of the machine. This supporting lever is equipped with a plate 19 extending partially over the end part 1. In this plate is provided an adjustment screw 20 for opposing the pull exerted by belt 16. Finally, the winding roller 13 is idling on a pivot 21 carried by an articulated arm 22 with the centre on the pivot 18 in axial alignment with the lever 17. Thanks to this structure the beamer roller is kept in operational contact with the driving roller 11 by its own weight with the fabric interposed in the same way as shown for the stretching roller 5. On this latter we have the pivot 9 of the lever 8 on which it is assembled and which is supported by the same supporting lever 17. In this way the fabric 2 arriving from the first pair of rollers 3 and 5 adhers first to the driving roller 11 which rotates at a reduced speed and cancels the elongation suffered previously, then is wound up in a roll 23 formed through the friction contact with the roller 11.

In the shown embodiment, the winding roller results to be engaged by a roll formed of a very narrow band, without the device described hereinabove being limited to this particular scope. The device object of this invention serves for the winding up of any type of weft or warped fabric or knitted cloth, in large sheets or narrow bands, stiff or elastic, which can now be wound up with a desired compactness, thanks to the differentiated alimentation controlled by the two pairs of rollers. For this reason, the here described device is particular useful for the winding up of rolls of a very elastic fabric.

What we claim is:

1. A beaming device for winding fabrics into rolls and in particular for winding very elastic fabrics, comprising a first pair of rollers for entraining the fabric from a source thereof: a winding roller around which the said fabric is to be rolled in a roll, a device in which the winding roller is made to rotate by a driving roller in turn rotated by an entraining roller of the first pair of rollers through a transmission comprising a speed controller.

2. A beaming device according to claim 1, in which the driving roller is arranged between the said first pair of rollers that comprise an entraining roller and a stretching roller, and said winding roller in such a manner that the fabric to be wound up passes over the driving roller before being rolled up upon the winding roller; the driving roller being rotatably driven at a reduced speed with respect to the stretching roller by the action of said speed controller to cancel deformation caused by the first pair of rollers.

3. A beaming device according to claim 2 in which the driving roller is connected to the entraining roller with a transmission comprising a driven pulley integrally fixed to the driving roller, a driving pulley of the variable diameter type with semidisks axially adjustable and being integrally connected to the entraining roller, and a transmission belt connecting the driving and driven pulleys; the winding roller being made to rotate by the driving roller through friction contact between said driving roller and the fabric being wound into a roll upon said winding roller.

4. A beaming apparatus for winding a web of material into a roll thereof, which comprises a base means; a pair of rollers supported by said base means for rotation relative thereto, a first roller of said pair of rollers being rotatably driven and a second roller of said pair of rollers being a freely rotatable idler roller, said first and second rollers being disposed to grip between them an incoming web of material and to draw said web into the apparatus at a given speed; a third roller supported by said base means for rotation relative thereto and rotatably driven, a fourth roller supported by said base means for rotation relative thereto, said fourth roller being a freely rotatable idler roller and disposed to support the web roll being wound from said incoming web; said third roller being disposed to receive said incoming web from said first and second rollers and to frictionally engage the web roll on said fourth roller to rotatably drive same to wind the web; and a transmission coupled to said first roller and to said third roller to drive said third roller at a predetermined reduced speed in relation to the speed of said first roller to relieve distortion in the web as wound into said web roll.

5. A beaming apparatus according to claim 4 wherein said second roller is carried by a lever pivotally moveable with respect to the base means to impart a gripping force to the incoming web passing between said first and second rollers established at least in part by the weight of said second roller and lever.

6. A beaming apparatus according to claim 4 wherein said transmission includes a variable diameter pully driven by one of said first and third rollers, another pulley connected for rotation in unison with the other of said first and third rollers, and an endless belt engaging said variable diameter and other pulleys to transmit motion from one to the other.

7. A beaming apparatus according to claim 4 wherein said third roller is carried by a lever pivotally connected to said base means.

8. A beaming apparatus according to claim 4 wherein said fourth roller is carried by a lever pivotally connected to said base means.

9. A beaming apparatus according to claim 7 wherein said second roller is carried by a lever pivotally connected to the lever that carries said third roller.

* * * * *